US009298135B2

(12) United States Patent
Fujiwara

(10) Patent No.: US 9,298,135 B2
(45) Date of Patent: Mar. 29, 2016

(54) IMAGE FORMING APPARATUS

(71) Applicant: KYOCERA Document Solutions Inc., Osaka-shi, Osaka (JP)

(72) Inventor: Daisuke Fujiwara, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/834,279

(22) Filed: Aug. 24, 2015

(65) Prior Publication Data

US 2016/0062272 A1 Mar. 3, 2016

(30) Foreign Application Priority Data

Aug. 27, 2014 (JP) ..... 2014-173274

(51) Int. Cl.
*G03G 15/08* (2006.01)

(52) U.S. Cl.
CPC ..... *G03G 15/0887* (2013.01)

(58) Field of Classification Search
CPC ..... G03G 15/556; G03G 15/0856; G03G 15/0831; G03G 15/086; G03G 15/0863
USPC ..... 399/27
See application file for complete search history.

(56) References Cited

FOREIGN PATENT DOCUMENTS

JP 2009025610 A 2/2009

OTHER PUBLICATIONS

Machine translation of Ichiji JP 2009-025610, publication date: Feb. 5, 2009.*

* cited by examiner

*Primary Examiner* — Walter L Lindsay, Jr.
*Assistant Examiner* — Frederick Wenderoth
(74) *Attorney, Agent, or Firm* — Alleman Hall McCoy Russell & Tuttle LLP

(57) ABSTRACT

A switch transmission mechanism of a first intermittent transmission mechanism 79 is switched between a transmission state and a non-transmission state, wherein in the transmission state, it transmits a rotational force to an intermediate rotator 72 based on an operation of an actuator 74. A second intermittent transmission mechanism 78 is switched between a transmission state and a non-transmission state, wherein in the transmission state, it transmits a rotational force of the intermediate rotator 72 to an output-side rotator 73.

9 Claims, 14 Drawing Sheets

IMAGE FORMING APPARATUS

INCORPORATION BY REFERENCE

This application is based upon and claims the benefit of priority from the corresponding Japanese Patent Application No. 2014-173274 filed on Aug. 27, 2014, the entire contents of which are incorporated herein by reference.

BACKGROUND

The present disclosure relates to an electrophotographic image forming apparatus.

In general, an electrophotographic image forming apparatus includes a developing portion and a developer supply portion. The developing portion includes a developing roller for supplying developer to an image carrier. The developer supply portion includes a developer conveying portion such as a developer delivering portion which, when rotationally driven, delivers the developer from a supply container storing the developer to the developing portion.

With a configuration where the developer conveying portion operates only when the amount of residual developer in the developing portion satisfies a predetermined supply condition, the amount of developer in the developing portion is maintained appropriately. In this case, it is necessary to cause the developer conveying portion to operate intermittently during the operation of the developing portion.

There is known, for example, a configuration where a clutch mechanism including a planetary gear and an actuator is provided in each of a plurality of developer supply portions. In this configuration, each actuator switches between a transmission and a non-transmission of power from one motor that continuously rotates, to a corresponding developer supply portion.

That is, each of the plurality of clutch mechanisms is switched between a transmission state of transmitting power of one motor (driving source) to the corresponding developer supply portion, and a non-transmission state of not transmitting the power. With such a configuration, it is possible to cause the developer supply portions to operate, independently of each other, intermittently while the motor is continuously rotating.

In addition, with the adoption of the clutch mechanism, the number of rotations of the developer conveying portion becomes proportional to the number of operations of the actuator. As a result, different from the case where the motor is caused to operate intermittently by the time control, it is possible to control the number of rotations of the developer conveying portion with high accuracy even if the rotation speed of the motor varies.

SUMMARY

An image forming apparatus according to an aspect of the present disclosure includes an input-side rotator, an intermediate rotator, an output-side rotator, a developer conveying portion, a first intermittent transmission mechanism, a second intermittent transmission mechanism, and a control portion. The input-side rotator is a member that is rotated continuously by a rotational force transmitted from a driving source. The intermediate rotator is a member that is rotated by a rotational force transmitted from the input-side rotator. The output-side rotator is a member that is rotated by a rotational force transmitted from the intermediate rotator. The developer conveying portion is rotated by a rotational force transmitted from the output-side rotator and conveys developer by being rotated. The first intermittent transmission mechanism includes an actuator and a switch transmission mechanism. The actuator operates based on the control signal input thereto. The switch transmission mechanism is selectively switched between a first connection state and a first non-connection state. The first connection state is a state in which the rotational force of the input-side rotator is transmitted to the intermediate rotator based on an operation of the actuator. The first non-connection state is a state in which the rotational force of the input-side rotator is not transmitted to the intermediate rotator. The second intermittent transmission mechanism is a mechanism that is selectively switched between a second connection state and a second non-connection state while the intermediate rotator is rotating. The second connection state is a state in which the rotational force of the intermediate rotator is transmitted to the output-side rotator. The second non-connection state is a state in which the rotational force of the intermediate rotator is not transmitted to the output-side rotator. The control portion outputs a control signal to the actuator. The second intermittent transmission mechanism includes an engaging portion, a restricting portion, a plurality of engaged portions, and a plurality of restricted portions. The engaging portion is a portion provided on an area of circumference of the intermediate rotator. The restricting portion is a portion provided on a remaining area of the circumference of the intermediate rotator. The restricting portion has an outer circumferential surface that extends along an arc whose center is a rotation center line of the intermediate rotator. The engaged portions are respectively provided on a plurality of areas of circumference of the output-side rotator and receive a rotational force from the engaging portion. The restricted portions are provided respectively on a plurality of remaining areas of the circumference of the output-side rotator and are each formed to have a recess indented in a shape of an arc so as to fit on the outer circumferential surface of the restricting portion. The second intermittent transmission mechanism enters the second connection state each time the engaging portion is engaged with any of the engaged portions, and enters the second non-connection state each time the outer circumferential surface of the restricting portion fits in the recess of any restricted portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the attached drawings. It should be noted that the following description is examples of specific embodiments of the present disclosure and should not limit the technical scope of the present disclosure.

First Embodiment

Figure 1:
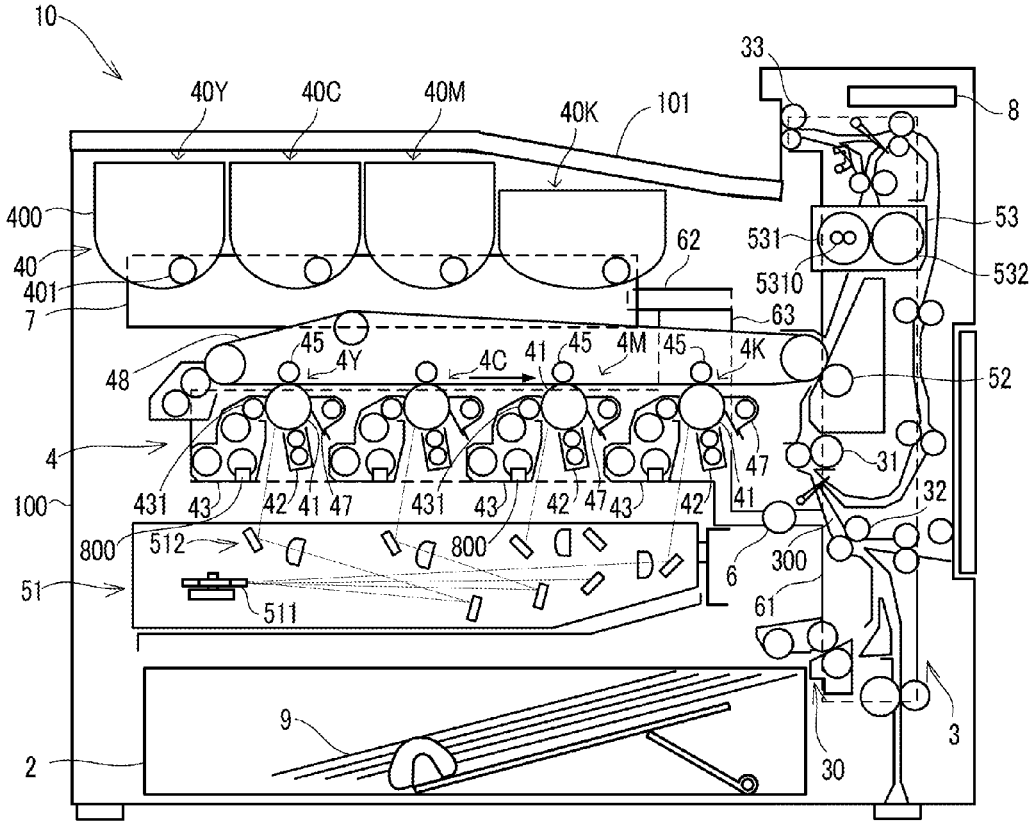
FIG. 1 is a configuration diagram of an image forming apparatus according to the first embodiment of the present disclosure.

First, a description is given of an outlined configuration of an image forming apparatus 10 according to the first embodiment of the present disclosure with reference to FIG. 1. The image forming apparatus 10 is an electrophotographic tandem image forming apparatus. In the example shown in FIG. 1, the image forming apparatus 10 is a color printer. Other examples of the image forming apparatus 10 include a color copier, a color facsimile, and a multifunction peripheral having a color image forming function.

The image forming apparatus 10 includes, in a housing 100, a sheet cassette 2, a sheet conveying portion 3, a plurality of developer supply portions 40, a plurality of image forming portions 4, an optical scanning portion 51, a secondary transfer portion 52, a fixing portion 53, an intermediate transfer belt 48, and a control portion 8. Furthermore, the image forming apparatus 10 includes a motor 6 and a developer supply portion driving mechanism 7.

The sheet cassette 2 is a portion for storing recording sheets 9 to which images are transferred, and can be attached to and detached from the housing 100. It is noted that the recording sheet 9 is a sheet-like image formation medium such as a sheet of paper, a sheet of coated paper, a postcard, an envelope, or an OHP sheet.

The sheet conveying portion 3 includes a sheet feed roller 30, a resist roller 31, a conveyance roller 32, and a discharge roller 33. The sheet feed roller 30 picks up the recording sheets 9 one by one from within the sheet cassette 2, and feeds the recording sheets 9 to a sheet conveyance path 300 of the sheet conveying portion 3.

The resist roller 31 and the conveyance roller 32 convey the recording sheet 9 along the sheet conveyance path 300. After an image is formed on the recording sheet 9 in the middle of the sheet conveyance path 300, the discharge roller 33 discharges the recording sheet 9 from a discharge port of the sheet conveyance path 300 onto a discharge tray 101.

The developer supply portions 40 and the image forming portions 4 are provided respectively in correspondence with the colors of the developer (toner). In the drawings, the signs Y, C, M and K respectively represent corresponding colors of the developer (yellow, cyan, magenta and black). The developers of the respective colors are supplied from the developer supply portions 40 to the image forming portions 4. The developer supply portions 40 are, for example, toner containers attached to the housing 100 in a detachable manner.

Each of the developer supply portions 40 includes a supply container 400 storing the developer and a developer delivering portion 401 that is rotationally driven. Each developer delivering portion 401 is rotationally driven so as to convey the developer in the supply container 400 to a developing portion 43 that is described below. Each developer delivering portion 401 is, for example, a screw-type conveyance member that includes a rotation shaft portion and a helical blade portion that is formed around the rotation shaft portion. It is noted that the developer delivering portion 401 is an example of the developer conveying portion configured to convey the developer.

The developer delivered by the developer delivering portions 401 may be supplied to the developing portions 43 directly. Alternatively, the developer delivered by the developer delivering portions 401 may be supplied to the developing portions 43 via intermediate conveyance portions (not shown). In this case, the developer delivering portions 401 are rotationally driven in such a way as to deliver the developer from the supply containers 400 to the developing portions 43 via the intermediate conveyance portions.

The image forming portions 4 are disposed along the endless and rotating intermediate transfer belt 48. The image forming portions 4 form a color toner image by overlaying images of different colors (toner images) on the surface of the rotating intermediate transfer belt 48.

Each image forming portion 4 includes a drum-like photoconductor 41, a charging portion 42, a developing portion 43, a primary transfer portion 45, a primary cleaning portion 47, and a developer amount sensor 800. The photoconductor 41 is an example of the image carrier. Furthermore, each image forming portion 4 includes a single-color developer supply portion driving mechanism 70 that is described below.

The intermediate transfer belt 48 is a belt-like member formed in the shape of an endless loop. The intermediate transfer belt 48 is rotated in the state where it is suspended between two rollers. In each image forming portion 4, the photoconductor 41 is rotated at a peripheral speed (moving speed) that corresponds to a peripheral speed of the intermediate transfer belt 48, and the charging portion 42 uniformly charges the surface of the photoconductor 41.

Furthermore, the optical scanning portion 51 including a laser light source (not shown), a polygon mirror 511, and an optical deflection instrument 512 scans laser light. With this operation, the optical scanning portion 51 writes an electrostatic latent image on the charged surface of the photoconductor 41.

The developing portion 43 includes a developing roller 431 that supplies developer to the photoconductor 41. The developing portion 43 develops the electrostatic latent image by supplying developer to the photoconductor 41 by the developing roller 431. The developer is supplied by the developer delivering portions 401 from the developer supply portions 40 to the developing portions 43. It is noted that the developing roller 431 may also be called a developing sleeve. In addition, the optical scanning portion 51 is generally called a laser scanning unit (LSU) or the like.

The developer amount sensor 800 is provided for each developing portion 43. The developer amount sensor 800 is a sensor for detecting the size of the amount of developer in the developing portion 43. The developer amount sensor 800 may be, for example, a permeability sensor that detects magnetism that varies in response to the amount of the developer in the developing portion 43. As another example, the developer amount sensor 800 may be a piezoelectric vibration type sensor that outputs a signal that varies depending on the amount of the developer (powder) present in the vicinity of the sensor. As a still another example, the developer amount sensor 800 may be a transmission type optical sensor.

The primary transfer portions 45 transfer the images (developer) on the surfaces of the photoconductors 41 to the surface of the intermediate transfer belt 48. Furthermore, the primary cleaning portions 47 clean the surfaces of the photoconductors 41 by removing the developer that remains on the surfaces of the photoconductors 41.

The secondary transfer portion 52 transfers the image (toner image) that has been transferred on the surface of the intermediate transfer belt 48, to the recording sheet 9 that is moving in the sheet conveyance path 300.

The fixing portion 53 nips the recording sheet 9 with the image formed thereon between a fixing roller 531, in which is embedded a heater 5310 such as a halogen heater, and a pressure roller 532 and feeds the sheet to a downstream step. In this operation, the fixing portion 53 heats the developer on the recording sheet 9 and fixes the image to the recording sheet 9.

In the present embodiment, the motor 6 is a driving source for driving the sheet conveying portion 3 that conveys the recording sheet 9 on which images of developer are transferred from the photoconductors 41. The motor 6 is, for example, a DC brushless motor. The control portion 8 activates the motor 6 so as to convey sheets when, for example, an image forming job is executed.

As one example, a sheet-conveyance-system gear mechanism 61 transmits a rotational force of one motor 6 to the rollers of the sheet conveying portion 3 such as the sheet feed roller 30 and the conveyance roller 32. This allows the rollers of the sheet conveying portion 3 to rotate in conjunction with the motor.

It is noted that, in the present embodiment, the motor 6 is also a driving source that rotationally drives the photoconductors 41 and the developing rollers 431. In this case, the photoconductors 41 and the developing rollers 431 respectively provided in the plurality of image forming portions 4 of respective colors of developer rotate upon receiving a power from one motor 6 that is a driving source common to those.

As one example, a developing-system gear mechanism 63 transmits a rotational force of one motor 6 to the photoconductors 41 and the developing rollers 431 of the image forming portions 4. This allows the plurality of photoconductors 41 and the plurality of developing rollers 431 to rotate in conjunction with the motor 6.

The developer supply portion driving mechanism 7 receives a rotational force from a driving source of another rotation mechanism, transmits the power to the developer delivering portions 401 of the developer supply portions 40 so as to rotate the developer delivering portions 401. In the present embodiment, the other rotation mechanism is a rotation mechanism for rotating the photoconductors 41 and the developing rollers 431.

Meanwhile, a mechanism that can switch between the transmission and non-transmission of the power from a continuously rotating driving source to the developer conveying portion, such as a power transmission mechanism configured to transmit power to the developer delivering portions 401 of the developer supply portions 40, may be realized by a clutch mechanism including a planetary gear.

In the clutch mechanism that obtains an intermittent rotational operation from the motor 6 that continuously rotates, when the actuator that switches between transmission and non-transmission of power operates at a slow speed, it is difficult to obtain an intermittent rotational operation at a wiggling angle while restricting reduction of the angle speed. Here, "an intermittent rotational operation at a wiggling angle" means an intermittent rotational operation with a small rotation angle per operation.

On the other hand, for example, in the mechanism configured to transmit power to the developer delivering portions 401 of the developer supply portions 40, it may be desired to obtain an intermittent rotational operation at a wiggling angle from the continuously rotating motor 6 while restricting reduction of the angle speed.

The motor 6 is a driving source that continuously rotates. The developer delivering portions 401 are an example of the developer conveying portion. The actuator switches between transmission and non-transmission of power from the motor 6 to the developer delivering portions 401. As indicated in the following, the developer supply portion driving mechanism 7 is able to cause the developer delivering portions 401 to intermittently rotate at a wiggling angle while restricting reduction of the angle speed even when the actuator operates at a slow speed.

The image forming apparatus 10 includes a supply-system input gear mechanism 62 that transmits the power (rotational force) of the continuously operating motor 6 to the developer supply portion driving mechanism 7. The developer supply portion driving mechanism 7 switches between a transmission state and a non-transmission state based on a control signal input from the control portion 8. In the transmission state, the power (rotational force) transmitted from the motor 6 via the supply-system input gear mechanism 62 is transmitted to the developer supply portions 40; and in the non-transmission state, the power is not transmitted to the developer supply portions 40. The developer supply portion driving mechanism 7 is configured to switch between the transmission state and the non-transmission state individually for each of the developer supply portions 40.

[Developer Supply Portion Driving Mechanism 7]

In the present embodiment, the developer supply portion driving mechanism 7 receives the power from the motor 6 and transmits the power to the developer delivering portions 401. As described above, the motor 6 is a driving source for driving the sheet conveying portion 3 that conveys the recording sheet 9.

Figure 2:
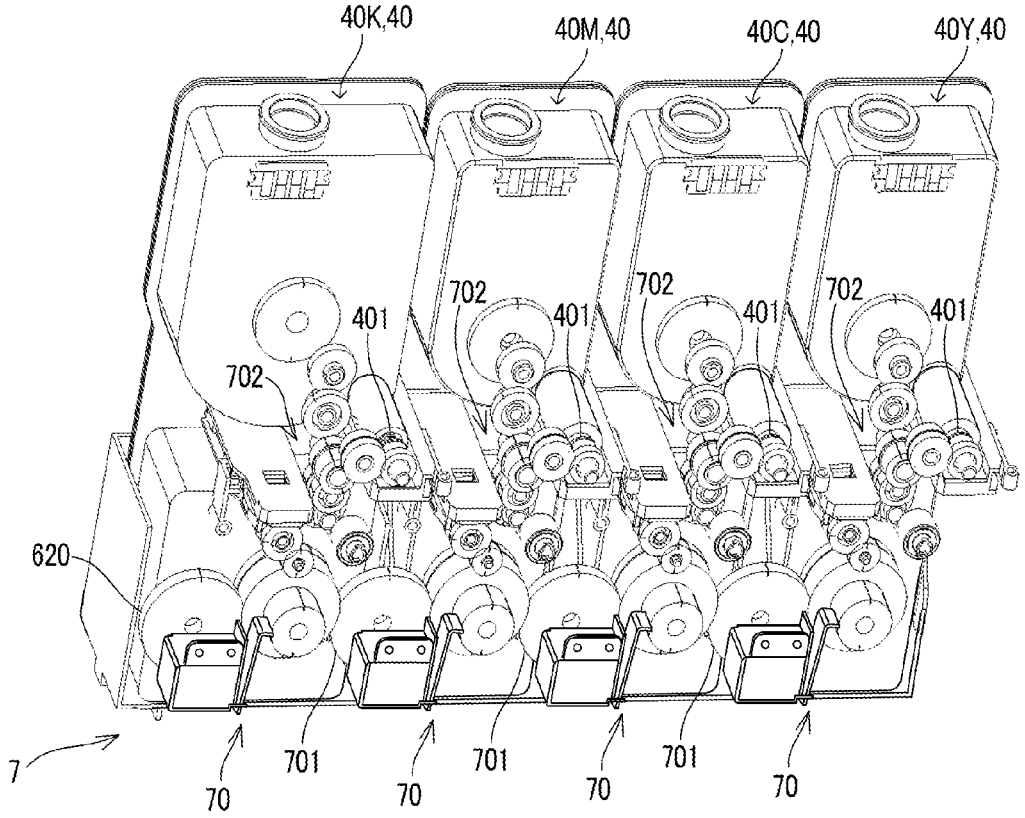
FIG. 2 is a perspective view of a developer supply portion driving mechanism in the image forming apparatus according to the first embodiment of the present disclosure.

FIG. 2 is a perspective view of the developer supply portion driving mechanism 7 and the developer supply portions 40 provided respectively for colors of yellow, cyan, magenta, and black in the image forming apparatus 10. The developer supply portion driving mechanism 7 includes a plurality of single-color developer supply portion driving mechanisms 70, a plurality of relay idle gears 701, and a plurality of output-system gear mechanisms 702. The single-color developer supply portion driving mechanisms 70 are provided respectively in the developer supply portions 40.

In the example shown in FIG. 2, a drive-side idle gear 620, which constitutes part of the supply-system input gear mechanism 62, transmits the power (rotational force) from the motor 6 to one of the single-color developer supply portion driving mechanisms 70. The relay idle gears 701 are each disposed between the single-color developer supply portion driving mechanisms 70. Each relay idle gear 701 transmits the power (rotational force) from one to the other of the two adjacent single-color developer supply portion driving mechanisms 70.

The output-system gear mechanisms 702 are respectively provided in the single-color developer supply portion driving mechanisms 70, and each output-system gear mechanism 702 transmits the power (rotational force) of the corresponding single-color developer supply portion driving mechanism 70 to the corresponding developer delivering portion 401.

Figure 3:
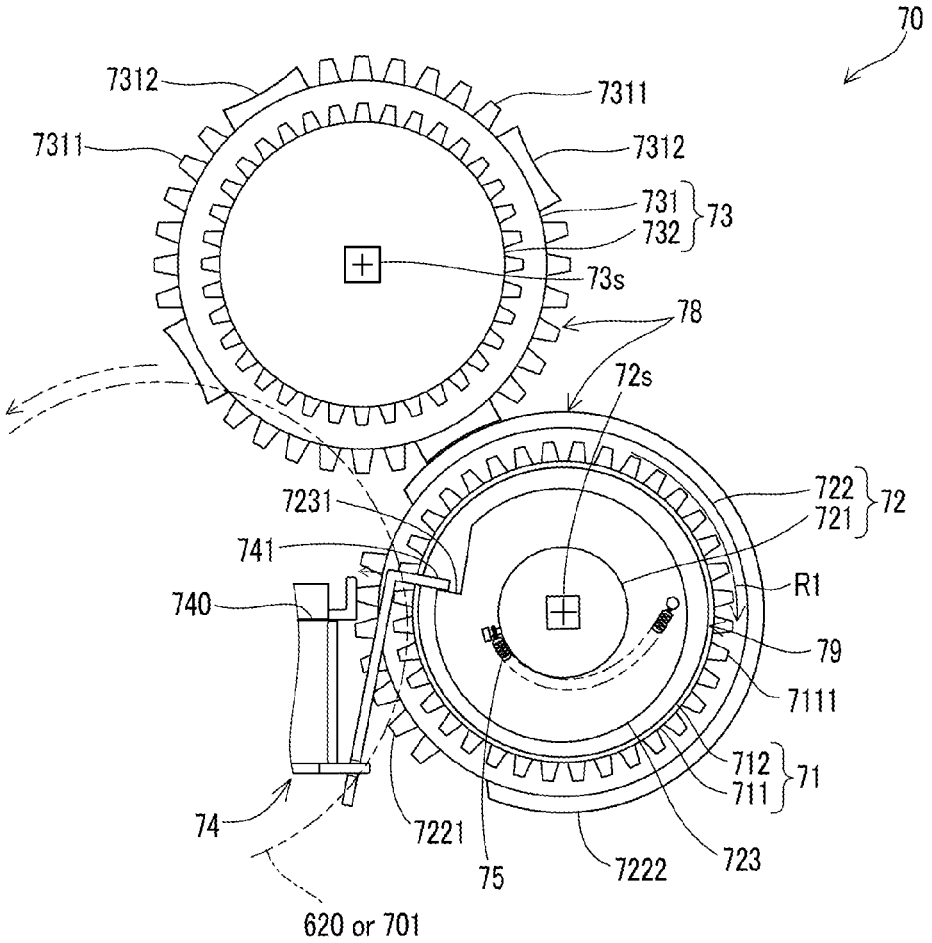
FIG. 3 is a front view of a single-color developer supply portion driving mechanism in the image forming apparatus according to the first embodiment of the present disclosure.

FIG. 3 is a front view of the single-color developer supply portion driving mechanism 70. Each single-color developer supply portion driving mechanism 70 includes an input-side rotator 71, an intermediate rotator 72, an output-side rotator 73, a first intermittent transmission mechanism 79, and a second intermittent transmission mechanism 78.

The input-side rotator 71 is a member that is continuously rotated by a rotational force transmitted from the operating motor 6. In the present embodiment, the input-side rotator 71 receives the rotational force from the operating motor 6 via either the drive-side idle gear 620 or the relay idle gear 701 that are continuously rotating.

The input-side rotator 71 includes an input-side idle gear 711 having teeth 7111 formed around its entire circumference. The teeth 7111 of the input-side idle gear 711 mesh with teeth of either the drive-side idle gear 620 or the relay idle gear 701. This allows the rotational force to be transmitted to the input-side idle gear 711 from either the drive-side idle gear 620 or the relay idle gear 701. With this configuration, the input-side rotator 71 is continuously rotated while the motor 6 is operating.

In the present embodiment, in the plurality of single-color developer supply portion driving mechanisms 70, each input-side rotator 71 and each relay idle gear 701 respectively transmit the rotational force to an adjacent relay idle gear 701 and an adjacent input-side rotator 71 for the rotational force to be transmitted sequentially. When the motor 6 is operating, the drive-side idle gear 620, the input-side rotators 71 and the relay idle gears 701 are continuously rotated.

That is, the drive-side idle gear 620 transmits the power (rotational force) from the motor 6 to the input-side rotator 71 of the first single-color developer supply portion driving mechanism 70. The first input-side rotator 71 transmits the rotational force to the first relay idle gear 701 that is adjacent to the first input-side rotator 71. The first relay idle gear 701 then transmits the rotational force to the input-side rotator 71 of the second single-color developer supply portion driving mechanism 70 that is adjacent to the first relay idle gear 701. The input-side rotator 71 of the second single-color developer supply portion driving mechanism 70 then transmits the rotational force to the second relay idle gear 701 that is adjacent to the second input-side rotator 71. Thereafter, the rotational force is transmitted in a similar manner. In this way, the input-side rotators 71 of the single-color developer supply portion driving mechanisms 70 rotate in conjunction with the motor 6.

In the following description, the rotation direction of the input-side rotators 71 driven by the motor 6 is referred to as a first rotation direction R1. In addition, the rotation direction opposite to the first rotation direction R1 is referred to as a second rotation direction R2.

The intermediate rotator 72 is a member that is rotated by the rotational force transmitted from the input-side rotator 71. The output-side rotator 73 is a member that is rotated by the rotational force transmitted from the intermediate rotator 72. The developer delivering portion 401 is rotated by the rotational force transmitted from the output-side rotator 73.

The output-side rotator 73 includes an output idle gear 732 having teeth formed around its entire circumference. When the output-side rotator 73 rotates, the rotational force is transmitted from the output idle gear 732, which is part of the output-side rotator 73, to the corresponding developer delivering portion 401 via the corresponding output-system gear mechanism 702, wherein the developer delivering portions 401 are an example of the developer conveying portion. This allows the developer delivering portions 401 to rotate in conjunction with the output-side rotators 73, and the developer is conveyed as the developer delivering portions 401 rotate.

The first intermittent transmission mechanism 79 includes an actuator 74 and a switch transmission mechanism 77. The actuator 74 operates based on a control signal input from the control portion 8.

The switch transmission mechanism 77 is a mechanism that is selectively switched between a first connection state and a first non-connection state based on the operation of the actuator 74. The first connection state is a state in which the rotational force of the input-side rotator 71 is transmitted to the intermediate rotator 72. The first non-connection state is a state in which the rotational force of the input-side rotator 71 is not transmitted to the intermediate rotator 72.

The second intermittent transmission mechanism 78 is a mechanism that is selectively switched between a second connection state and a second non-connection state while the intermediate rotator 72 is rotating. The connection state is a state in which the rotational force of the intermediate rotator 72 is transmitted to the output-side rotator 73. The second non-connection state is a state in which the rotational force of the intermediate rotator 72 is not transmitted to the output-side rotator 73.

In the present embodiment, the switch transmission mechanism 77 is a well-known one-rotation clutch, and includes an outer ring portion 712, an inner ring portion 721, a trip cam portion 723, and an elastic member 75. The outer ring portion 712 is a part of the input-side rotator 71, and the inner ring portion 721 is a part of the intermediate rotator 72.

Furthermore, the switch transmission mechanism 77 includes a plurality of rollers (not shown) that are disposed between the outer ring portion 712 (the driving side) and the inner ring portion 721 (the driven side). The trip cam portion 723 is configured to be rotated between a first rotational position and a second rotational position relative to the inner ring portion 721.

When the trip cam portion 723 is positioned at the first rotational position with respect to the inner ring portion 721, the plurality of rollers mesh in a wedge-like manner between the outer ring portion 712 and the inner ring portion 721. This allows the rotational force to be transmitted from the outer ring portion 712 to the inner ring portion 721. When the trip cam portion 723 is positioned at the second rotational position with respect to the inner ring portion 721, the plurality of rollers rotate as rolling bodies between the outer ring portion 712 and the inner ring portion 721. This allows the transmission of the rotational force from the outer ring portion 712 to the inner ring portion 721 to be released.

By its elastic force, the elastic member 75 such as a coil spring keeps the trip cam portion 723 to be at the first rotational position in the rotation direction with respect to the inner ring portion 721. This allows the plurality of rollers to mesh in a wedge-like manner between the outer ring portion 712 and the inner ring portion 721.

The actuator 74 is switched between a locking state and a retracting state based on an input control signal. In the present embodiment, the locking state is a state where the actuator 74 is engaged with a part of the trip cam portion 723 and thereby the trip cam portion 723 is stopped from rotating. The retracting state is a state where the engagement with the trip cam portion 723 is released.

Figure 4:
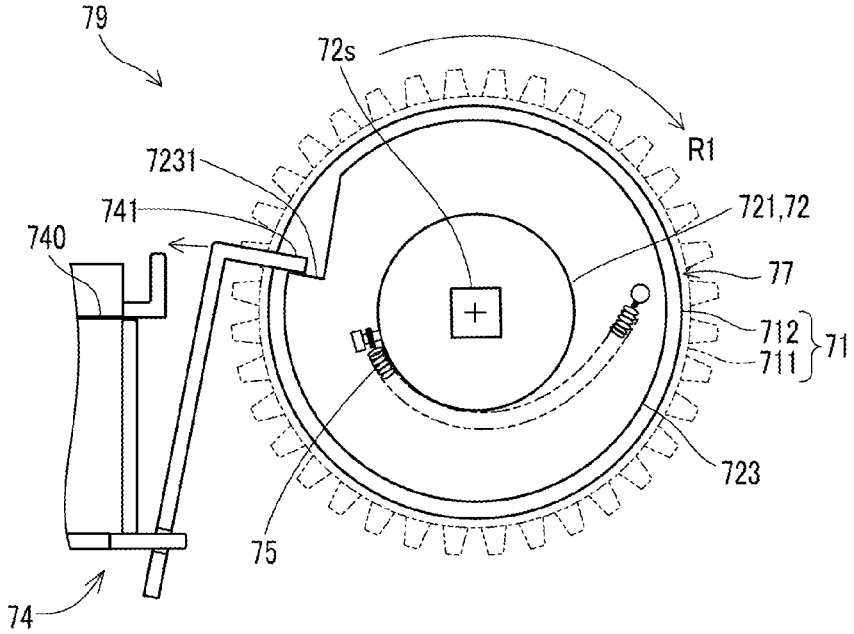
FIG. 4 is a first front view of a first intermittent transmission mechanism in the image forming apparatus according to the first embodiment of the present disclosure.
Figure 5:
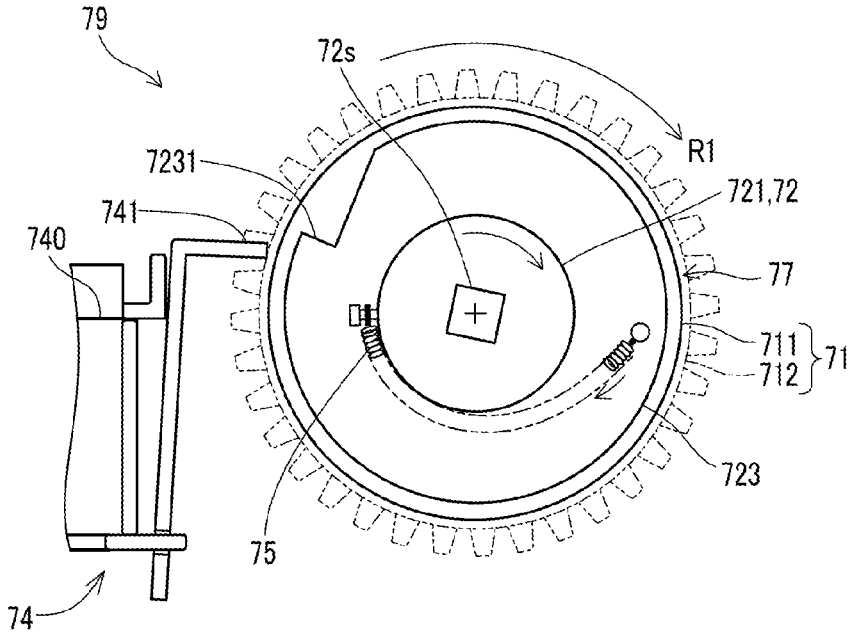
FIG. 5 is a second front view of the first intermittent transmission mechanism in the image forming apparatus according to the first embodiment of the present disclosure.

In the present embodiment, the actuator 74 is a solenoid actuator. The actuator 74 shown in FIGS. 3-5 is called a flapper solenoid or the like. The adoption of the solenoid actuator makes it possible to realize the actuator 74 by a low cost. The actuator 74 includes an electromagnet portion 740 and a displacement portion 741. The electromagnet portion 740 causes the displacement portion 741 to be displaced between a locking position and a retracting position based on the control signal. The state where the displacement portion 741 is positioned at the locking position is the locking state, and the state where the displacement portion 741 is positioned at the retracting position is the retracting state.

As shown in FIG. 4, when the displacement portion 741 of the actuator 74 is present at the locking position, the displacement portion 741 is hooked on an engaged portion 7231 of the trip cam portion 723. With this configuration, the displacement portion 741, resisting against the elastic force of the elastic member 75, causes the trip cam portion 723 to be displaced from the first rotational position to the second rotational position. This allows the transmission of the rotational force from the outer ring portion 712 to the inner ring portion 721 to be released, and the inner ring portion 721 stops rotating.

On the other hand, as shown in FIG. 5, when the displacement portion 741 of the actuator 74 is displaced from the engaging position to the retracting position, the displacement portion 741 is released from being hooked on the engaged portion 7231 of the trip cam portion 723. As a result, by the elastic force of the elastic member 75, the trip cam portion 723 is kept to be at the first rotational position in the rotation direction with respect to the inner ring portion 721. This allows the rotational force to be transmitted from the outer ring portion 712 to the inner ring portion 721, and the intermediate rotator 72 rotates in the first rotation direction R1.

In the present embodiment, the engaged portion 7231 is provided only at one place on the circumference of the trip cam portion 723. As a result, each time the actuator 74 makes one operation while the outer ring portion 712 is rotating, the intermediate rotator 72 makes at least one rotation. It is noted that the intermediate rotator 72 can be set to make as many rotations as an integer multiple of one each time the actuator 74 makes one operation, by adjusting the time period for which the actuator 74 is in the retracting state.

It is noted that the engaged portion 7231 may be provided at a plurality of places on the circumference of the trip cam portion 723. The configuration makes it possible for the intermediate rotator 72 to make less than one rotation each time the actuator 74 makes one operation, while the outer ring portion 712 is rotating.

The second intermittent transmission mechanism 78 is a mechanism that allows the output-side rotator 73 to rotate intermittently while the intermediate rotator 72 is rotating. As shown in FIGS. 6-9, the second intermittent transmission mechanism 78 includes an intermediate output teeth missing gear 722 and an output teeth missing gear 731, wherein the intermediate output teeth missing gear 722 is a part of the intermediate rotator 72, and the output teeth missing gear 731 is a part of the output-side rotator 73.

The inner ring portion 721 of the switch transmission mechanism 77 and the intermediate output teeth missing gear 722 are rotatably supported in the state where they are connected to each other by an intermediate rotation shaft portion 72*s*. As a result, when the inner ring portion 721 rotates, the intermediate rotation shaft portion 72*s* rotates in the same direction, and it allows the intermediate output teeth missing gear 722 to rotate in the same direction.

In addition, the output teeth missing gear 731 and the output idle gear 732 are rotatably supported in the state where they are connected to each other by an output-side rotation shaft portion 73*s*. As a result, when the output teeth missing gear 731 rotates, the output-side rotation shaft portion 73*s* rotates in the same direction, and it allows the output idle gear 732 to rotate in the same direction.

The intermediate output teeth missing gear 722 is a teeth missing gear, wherein teeth 7221 are formed on an area of the circumference of the intermediate rotator 72, and a restricting portion 7222 having no teeth is provided on the remaining area of the circumference of the intermediate rotator 72.

The output teeth missing gear 731 is a teeth missing gear, wherein teeth 7311 are formed on a plurality of areas of the circumference of the output-side rotator 73, and restricted portions 7312 having no teeth are provided respectively on the remaining areas of the circumference of the output-side rotator 73. When the intermediate output teeth missing gear 722 rotates and reaches a position where the teeth 7221 of the intermediate output teeth missing gear 722 face the intermediate rotator 72, the teeth 7221 mesh with the teeth 7311 of the output teeth missing gear 731.

When the teeth 7221 of the intermediate output teeth missing gear 722 mesh with the teeth 7311 of the output teeth missing gear 731, the output teeth missing gear 731 rotates following the intermediate output teeth missing gear 722. This allows the output-side rotator 73 to rotate following the intermediate rotator 72.

The teeth 7221 of the intermediate output teeth missing gear 722 are an example of the engaging portion provided on an area of the circumference of the intermediate rotator 72. The teeth 7311 of the output teeth missing gear 731 are an example of the plurality of engaged portions provided on a plurality of areas of the circumference of the output-side rotator 73 and receiving the rotational force from the teeth 7221 of the intermediate output teeth missing gear 722.

The restricting portion 7222 provided on the teeth missing portion of the intermediate output teeth missing gear 722 includes an outer circumferential surface 7223 that extends along an arc whose center is a rotation center line 72*o* of the intermediate rotator 72. Each restricted portion 7312 of the output teeth missing gear 731 is formed to have, in the outer surface thereof, a recess that is indented in the shape of an arc so as to fit on the outer circumferential surface 7223 of the restricting portion 7222. That is, the surface of each restricted portion 7312 is formed in the shape of an arc extending along the outer circumferential surface 7223 of the restricting portion 7222 with a slight play therebetween.

The second intermittent transmission mechanism 78 enters the second connection state each time the teeth 7221 of the intermediate output teeth missing gear 722 are engaged with the teeth 7311 of any area on the circumference of the output teeth missing gear 731. Furthermore, the second intermittent transmission mechanism 78 enters the second non-connection state each time the outer circumferential surface 7223 of the restricting portion 7222 of the intermediate output teeth missing gear 722 fits in the recess of any restricted portion 7312 of the output teeth missing gear 731.

Figure 6:
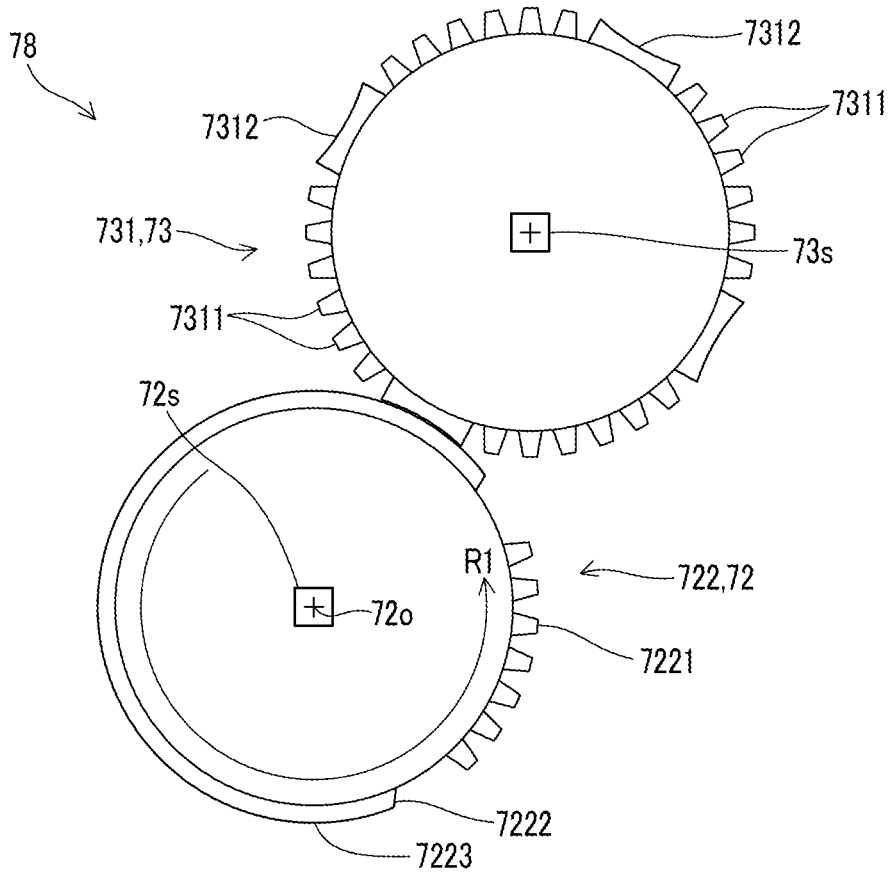
FIG. 6 is a first front view of a second intermittent transmission mechanism in the image forming apparatus according to the first embodiment of the present disclosure.
Figure 7:
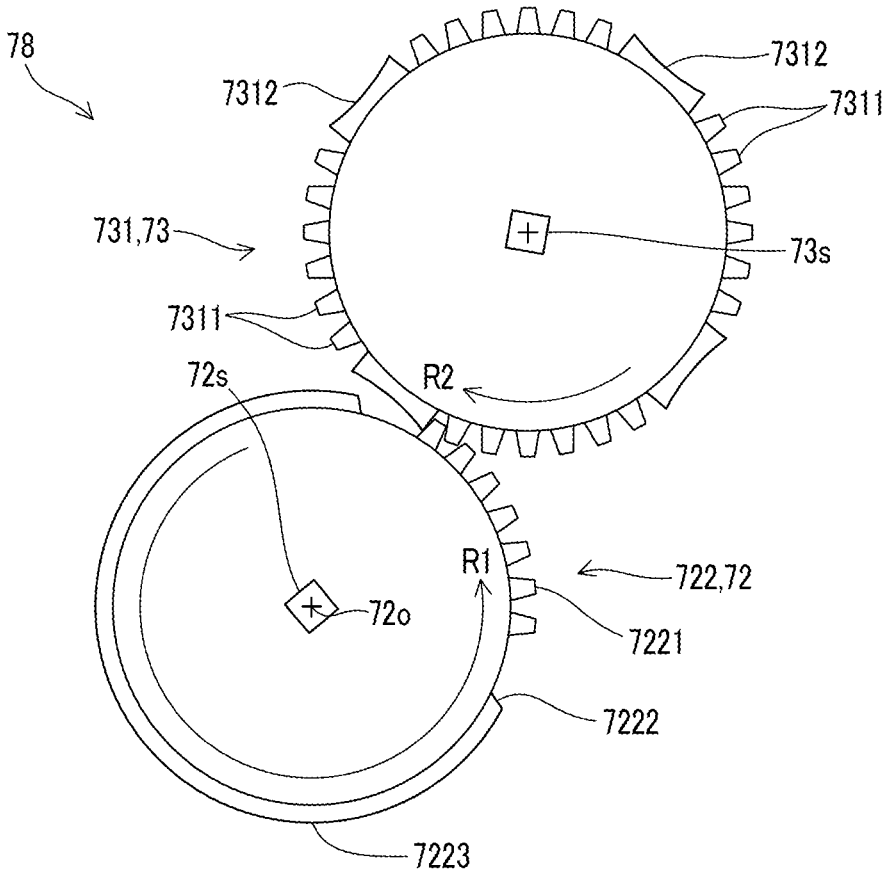
FIG. 7 is a second front view of the second intermittent transmission mechanism in the image forming apparatus according to the first embodiment of the present disclosure.
Figure 8:
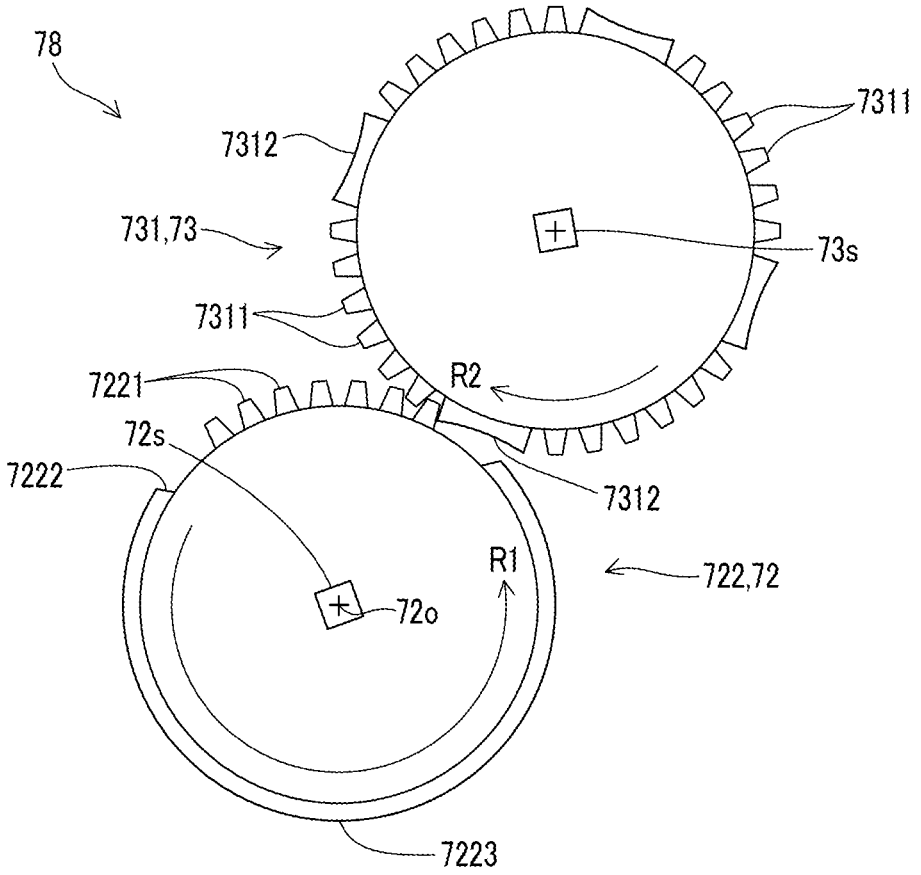
FIG. 8 is a third front view of the second intermittent transmission mechanism in the image forming apparatus according to the first embodiment of the present disclosure.
Figure 9:
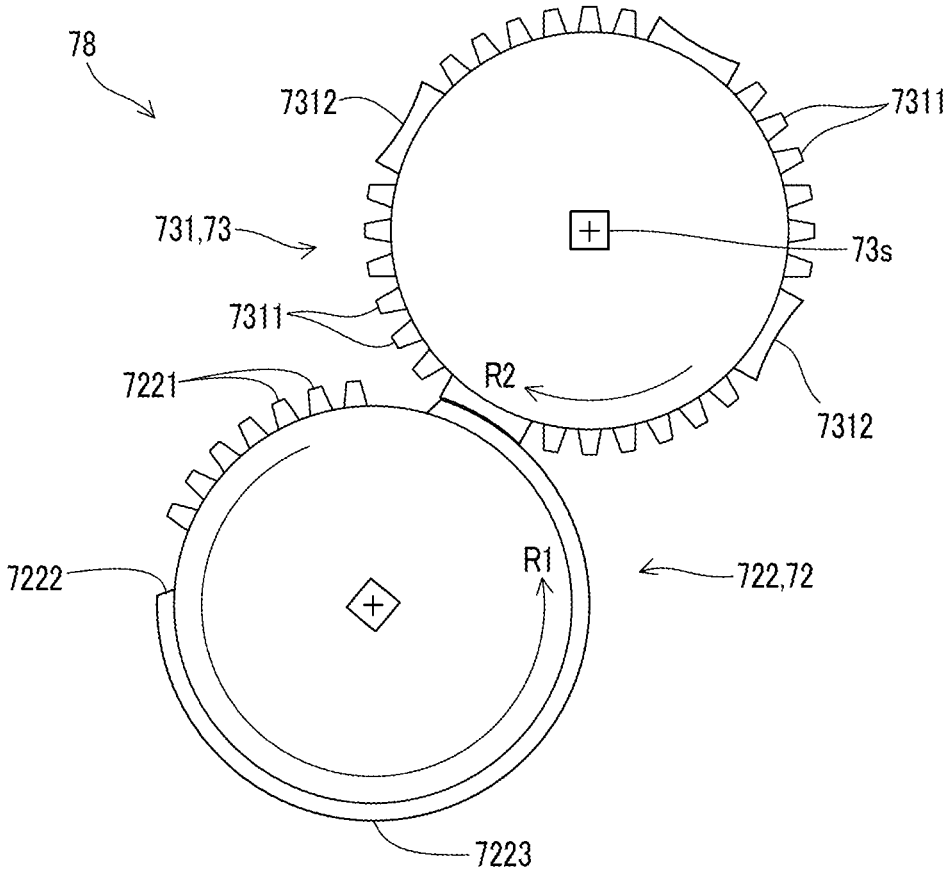
FIG. 9 is a fourth front view of the second intermittent transmission mechanism in the image forming apparatus according to the first embodiment of the present disclosure.

FIG. 6 and FIG. 9 show the second intermittent transmission mechanism 78 in the second non-connection state. FIG. 7 and FIG. 8 show the second intermittent transmission mechanism 78 in the second connection state.

For example, when the first intermittent transmission mechanism 79 is in the first non-connection state, the second intermittent transmission mechanism 78 is in the second non-connection state as shown in FIG. 6. When the intermediate rotator 72 rotates by the switch of the first intermittent transmission mechanism 79 from the first non-connection state to the first connection state, the second intermittent transmission mechanism 78 is switched from the second non-connection state shown in FIG. 6 to the second connection state shown in FIG. 7.

Subsequently, while the intermediate rotator 72 makes one rotation, the second intermittent transmission mechanism 78 is switched from the second connection state shown in FIG. 7 to the second connection state shown in FIG. 8, and then to the second non-connection state shown in FIG. 9. When the second intermittent transmission mechanism 78 is in the second non-connection state as such, the output teeth missing gear 731 stops rotating, and the output-side rotator 73 is kept to stop.

When the second intermittent transmission mechanism 78 enters the second non-connection state while the intermediate rotator 72 is rotating, the outer circumferential surface 7223 of the restricting portion 7222 rotationally moves in the state where it is located away from the surface of the restricted portions 7312 by a small distance, or rotationally moves while sliding on the surface of the restricted portions 7312.

Even if an external force in the rotation direction is applied to the output-side rotator 73 when the second intermittent transmission mechanism 78 is in the second non-connection state, the rotation of the output-side rotator 73 is restricted since the restricted portion 7312 gets stuck to the restricting portion 7222.

In the example shown in FIGS. 6-9, the teeth 7221 of the intermediate output teeth missing gear 722 are formed on one area of the circumference of the intermediate rotator 72, and only one restricting portion 7222 of the intermediate output teeth missing gear 722 is formed on the remaining area of the circumference of the intermediate rotator 72.

Furthermore, in the example shown in FIGS. 6-9, the teeth 7311 of the output teeth missing gear 731 are formed on four areas of the circumference of the output-side rotator 73, and the restricted portions 7312 of the output teeth missing gear 731 are respectively formed on the remaining four areas of the circumference of the output-side rotator 73.

As a result, in the example shown in FIGS. 6-9, each time the intermediate rotator 72 makes one rotation, the output-side rotator 73 makes one-fourth rotation.

The control portion 8 outputs a control signal to the actuator 74 while the motor 6 is operating, namely, while the rollers of the sheet conveying portion 3 are rotating.

More specifically, when the developer amount sensor 800 satisfies a predetermined supply condition while the motor 6 is operating, the control portion 8 outputs a control signal to the actuator 74 so as to switch the actuator 74 from the retracting state to the locking state.

The supply condition is that, for example, the developer amount sensor 800 detects that the amount of developer is less than a predetermined proper lower-limit amount. The state where the supply condition is satisfied is a state where the amount of developer in the developing portion 43 has reached a minimum amount required to perform a proper development.

It is noted that the supply condition to be adopted may be that the developer amount sensor 800 continues to detect for a predetermined period that the amount of developer is less than the proper lower-limit amount.

In the image forming apparatus 10, the developer supply portion driving mechanism 7 is switched between the transmission and non-transmission of the power from the motor 6 to the developer delivering portion 401 of the developer supply portions 40, based on the control signal from the control portion 8. With this configuration, the developer supply portion driving mechanism 7 can cause the developer delivering portion 401 to operate intermittently while the motor 6 is operating.

It is noted that a typical example of the case where the control portion 8 causes the developer delivering portion 401 to operate intermittently while the motor 6 is operating is the case where the developer amount sensor 800 satisfies the supply condition.

The above-described single-color developer supply portion driving mechanisms 70 are switched between the transmission state of transmitting the power of one motor 6 to the developer delivering portion 401, and the non-transmission state of not transmitting the power. This makes it possible to cause each of the plurality of developer delivering portion 401 to intermittently operate independently while the motor 6 is operating continuously.

In addition, with the adoption of the single-color developer supply portion driving mechanisms 70, it is possible to control the number of rotations of the developer delivering portion 401 with high accuracy by the number of operations of the actuator 74 even when the rotation speed of the motor 6 varies. This is a difference from the case where dedicated motors respectively provided in the developer supply portions 40 are intermittently operated by the time control.

Furthermore, it is possible to cause the developer delivering portion 401 to rotate intermittently at a wiggling angle while restricting reduction of the angle speed even when the actuator that switches between the transmission and non-transmission of the power from the continuously rotating motor 6 to the developer delivering portion 401 operates at a slow speed.

In addition, the input-side rotator 71 is rotated by the power received from the motor 6 that drives the sheet conveying portion 3. That is, one motor 6 is used in common as the driving source of the sheet conveying portion 3 and the input-side rotator 71. This makes it possible to realize the developer supply portion driving mechanism 7 in a simple configuration at a low cost.

Furthermore, in the present embodiment, the input-side rotators 71 of the plurality of image forming portions 4 are rotated by the power received from the motor 6 that is used in common. This further increases the effect of simplification and cost reduction of the driving source.

Second Embodiment

Next, a description is given of an image forming apparatus according to the second embodiment of the present disclosure with reference to FIGS. 10-15. The image forming apparatus of the second embodiment has a configuration where the first intermittent transmission mechanism 79 of the image forming apparatus 10 has been replaced with a first intermittent transmission mechanism 79A.

Figure 10:
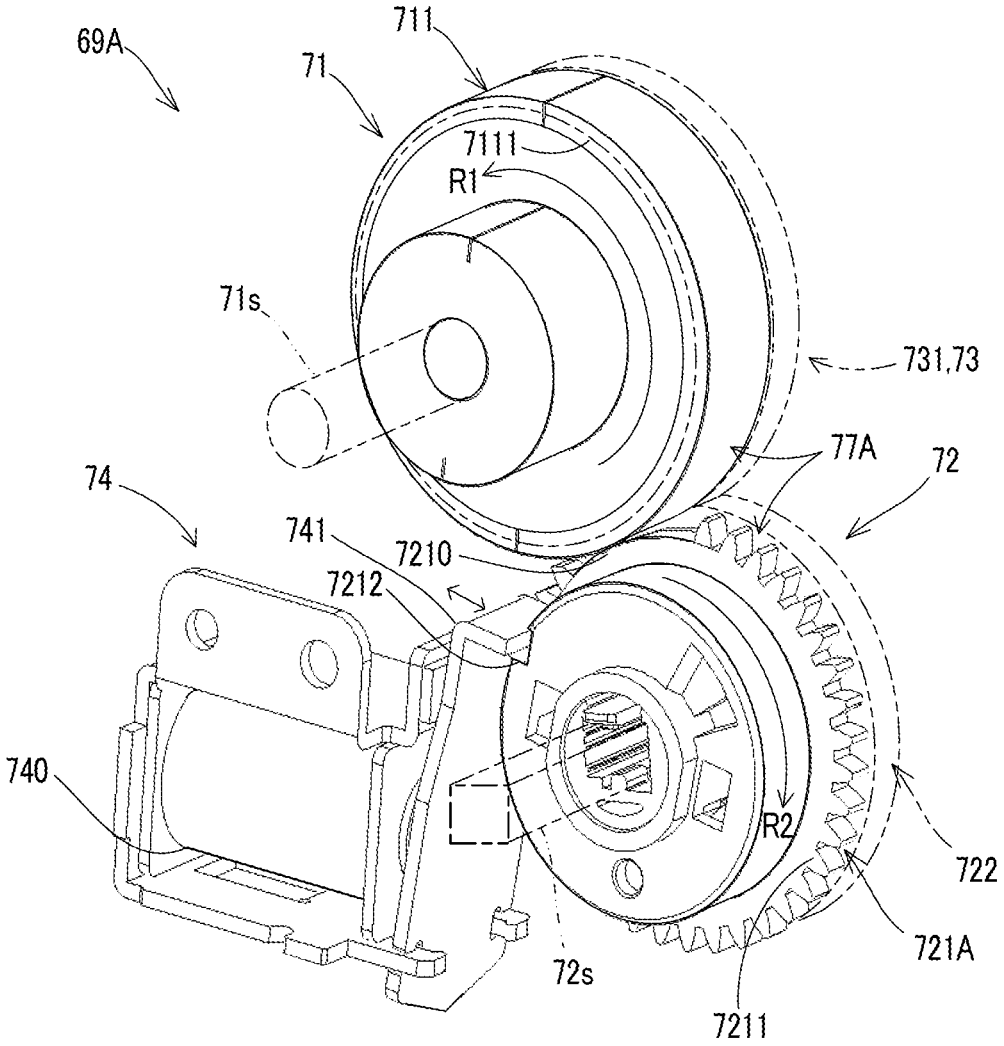
FIG. 10 is a perspective view of a first intermittent transmission mechanism in an image forming apparatus according to the second embodiment of the present disclosure.
Figure 11:
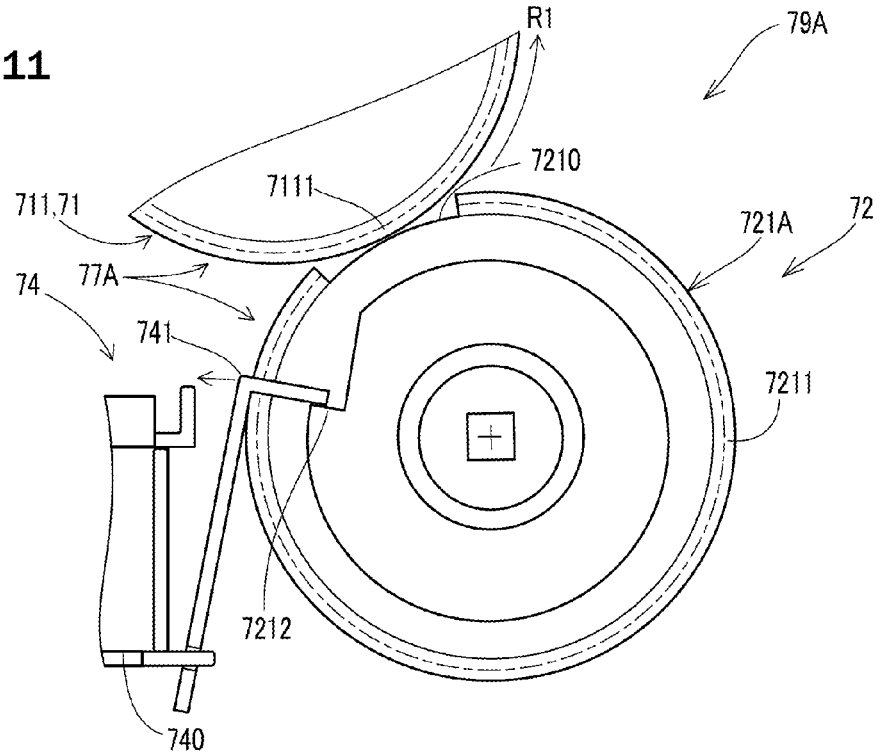
FIG. 11 is a first front view of the first intermittent transmission mechanism in the image forming apparatus according to the second embodiment of the present disclosure.
Figure 12:
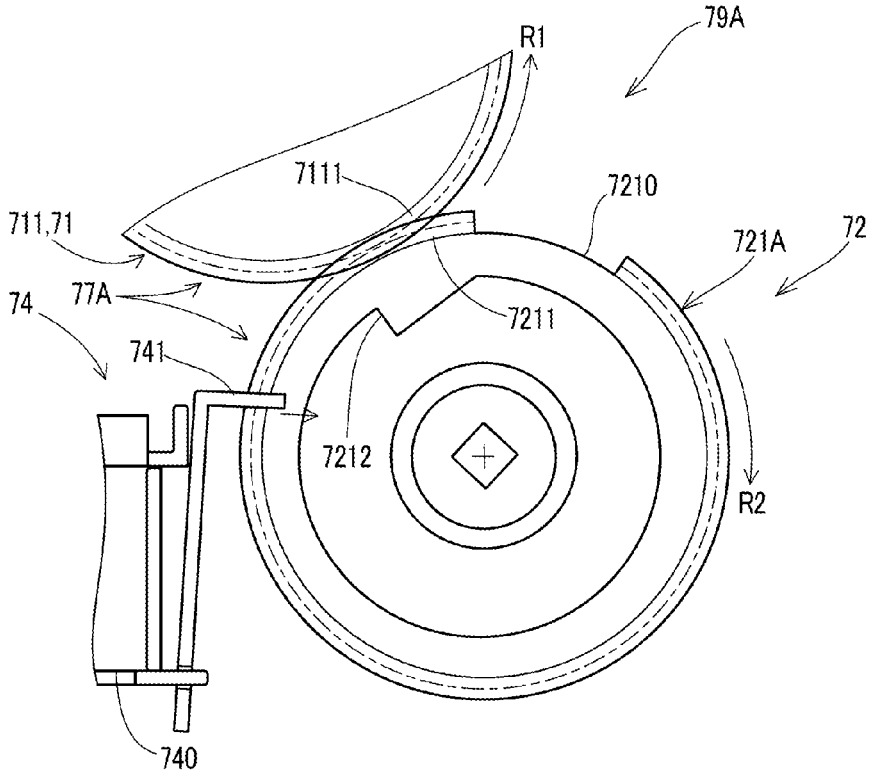
FIG. 12 is a second front view of the first intermittent transmission mechanism in the image forming apparatus according to the second embodiment of the present disclosure.
Figure 13:
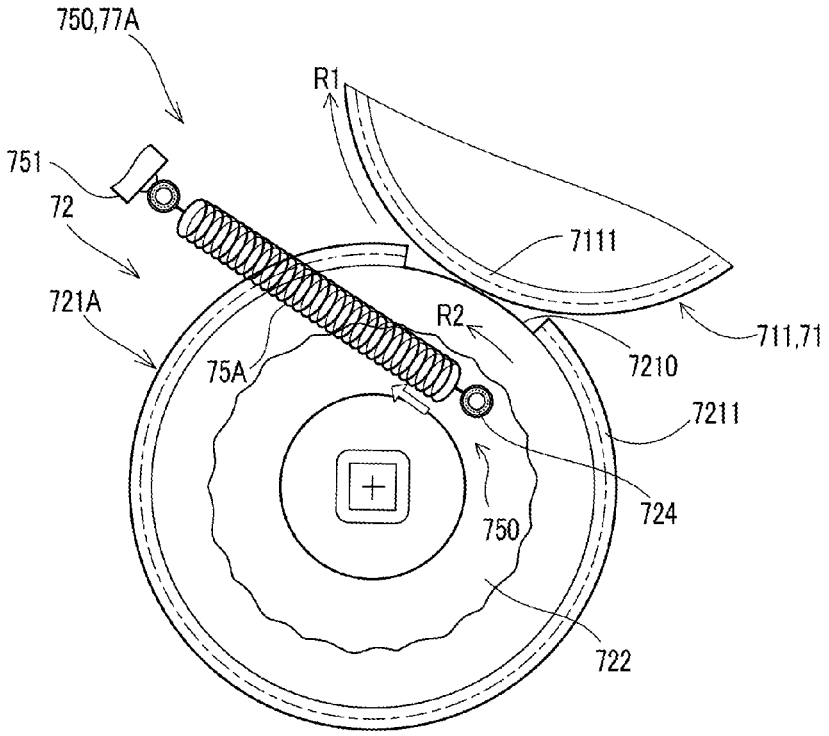
FIG. 13 is a first front view of an elastic rotation mechanism of the first intermittent transmission mechanism in the image forming apparatus according to the second embodiment of the present disclosure.
Figure 14:
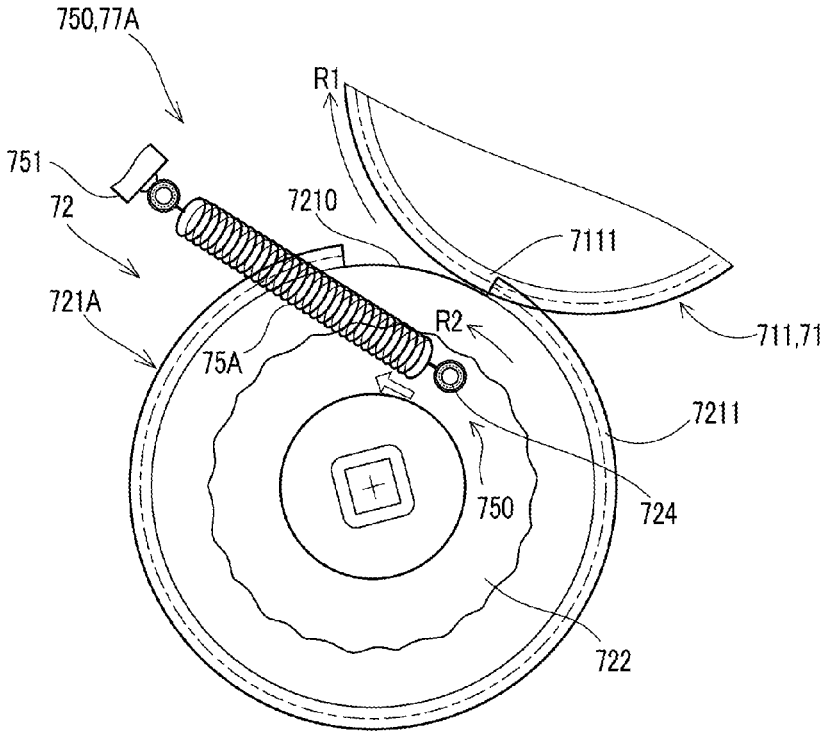
FIG. 14 is a second front view of the elastic rotation mechanism of the first intermittent transmission mechanism in the image forming apparatus according to the second embodiment of the present disclosure.
Figure 15:
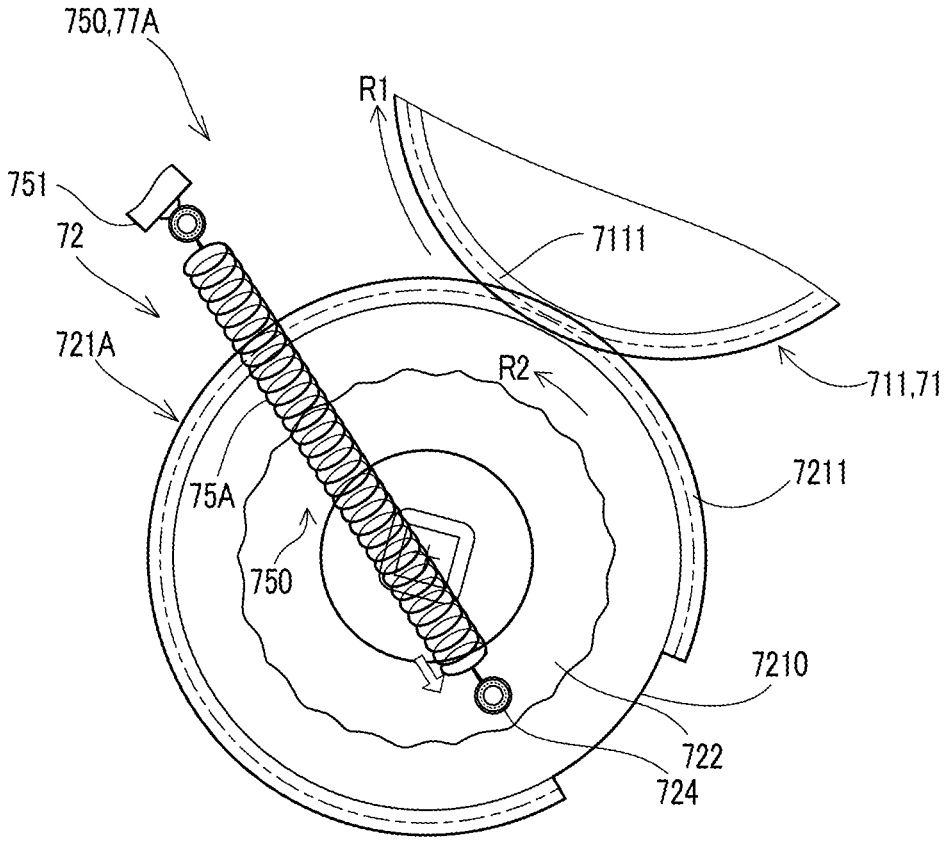
FIG. 15 is a third front view of the elastic rotation mechanism of the first intermittent transmission mechanism in the image forming apparatus according to the second embodiment of the present disclosure.

FIG. 10 is a perspective view of the first intermittent transmission mechanism 79A. FIGS. 11 and 12 are front views of the first intermittent transmission mechanism 79A. FIGS. 13-15 are partial front views of an elastic rotation mechanism 750 provided in the first intermittent transmission mechanism 79A. It is noted that in FIGS. 10-15, the same components as those shown in FIGS. 1-14 are assigned the same reference signs.

In the image forming apparatus of the second embodiment, each single-color developer supply portion driving mechanism 70 includes the first intermittent transmission mechanism 79A instead of the first intermittent transmission mechanism 79. The first intermittent transmission mechanism 79A includes the actuator 74 and a switch transmission mechanism 77A. The actuator 74 operates based on a control signal input from the control portion 8.

The switch transmission mechanism 77A includes the input-side idle gear 711 that is a part of the input-side rotator 71, an intermediate input teeth missing gear 721A that is a part of the intermediate rotator 72, and an elastic member 75A.

In the present embodiment, the input-side rotator 71 and the output teeth missing gear 731 of the output-side rotator 73 are rotatably supported by an input-side rotation shaft portion 71*s* in such a way that the input-side rotator 71 and the output teeth missing gear 731 can rotate independently of each other.

Furthermore, in the present embodiment, the intermediate input teeth missing gear 721A and the intermediate output teeth missing gear 722 of the second intermittent transmission mechanism 78 are rotatably supported by an intermediate rotation shaft portion 72*s* in the state where the intermediate input teeth missing gear 721A, the intermediate output teeth missing gear 722, and the intermediate rotation shaft portion 72*s* are integrally connected with each other. As a result, when the intermediate input teeth missing gear 721A rotates, the intermediate rotation shaft portion 72*s* rotates in the same direction, and it allows the intermediate output teeth missing gear 722 to rotate in the same direction.

It is noted that in FIG. 10, the input-side rotation shaft portion 71*s*, the intermediate rotation shaft portion 72*s*, the intermediate output teeth missing gear 722, and the output teeth missing gear 731 are drawn by an imaginary line (two-dot chain line).

The input-side idle gear 711 of the input-side rotator 71 is a gear having teeth formed around its entire circumference. The teeth of the input-side idle gear 711 are referred to as first teeth 7111. The input-side idle gear 711 transmits a rotational force to the intermediate rotator 72. It is noted that in the drawings, the teeth formed around the entire circumference of the input-side idle gear 711 are drawn in a simplified manner.

The intermediate input teeth missing gear 721A of the intermediate rotator 72 is a teeth missing gear wherein a first teeth missing portion 7210 having no teeth is formed on an area of the circumference, and second teeth 7211 are formed on the remaining area of the circumference so as to mesh with the teeth 7111. It is noted that in FIGS. 11-15, the first teeth 7111 and the second teeth 7211 are drawn in a simplified manner.

The intermediate rotator 72 is rotatably supported by the intermediate rotation shaft portion 72*s*. When the first teeth missing portion 7210 is in a state where it faces the first teeth of the input-side idle gear 711, the rotational force of the input-side idle gear 711 is not transmitted to the intermediate input teeth missing gear 721A. On the other hand, when the second teeth 7211 are in a state where they mesh with the first teeth 7111, the rotational force of the input-side idle gear 711 is transmitted to the intermediate input teeth missing gear 721A. This allows the intermediate rotator 72 to rotate in conjunction with the input-side rotator 71.

In the following description, the state where the first teeth missing portion 7210 faces the first teeth of the input-side idle gear 711 is expressed as "the intermediate rotator 72 is in the non-connection state". In addition, the state where the second teeth 7211 mesh with the first teeth 7111 is expressed as "the intermediate rotator 72 is in the connection state".

FIGS. 10, 11 and 13 are diagrams showing that the intermediate rotator 72 is in the non-connection state, and FIGS. 12, 14 and 15 are diagrams showing that the intermediate rotator 72 is in the connection state. Only when the intermediate rotator 72 is in the connection state, the intermediate input teeth missing gear 721A rotates following the input-side idle gear 711, and this allows the intermediate rotator 72 to rotate.

When the intermediate input teeth missing gear 721A rotates following the input-side idle gear 711, the intermediate rotator 72 transmits the rotational force to the developer delivering portion 401 via the second intermittent transmission mechanism 78.

The elastic member 75A shown in FIGS. 13-15 is a member that causes the intermediate rotator 72 to rotate from the non-connection state to the connection state by applying the elastic force to the intermediate rotator 72. The elastic member 75A causes the intermediate rotator 72 in the non-connection state to rotate in the second rotation direction R2. With this operation, the intermediate rotator 72 is changed to the connection state.

The actuator 74 shown in FIGS. 10-12 operates based on the control signal input from the control portion 8. The actuator 74 is switched between the locking state and the retracting state based on the input control signal. The locking state is a state where the actuator 74 is engaged with a part of the intermediate rotator 72 and thereby the intermediate rotator 72 is kept to be in the non-connection state. The retracting state is a state where the rotation of the intermediate rotator 72 is not restricted.

In the present embodiment, the actuator 74 is a solenoid actuator. The electromagnet portion 740 of the actuator 74 causes the displacement portion 741 to be displaced between the locking position and the retracting position based on the control signal.

The intermediate rotator 72 is caused to rotate in the second rotation direction R2 by the rotational force received from the input-side idle gear 711. At that time, when the attitude of the intermediate rotator 72 becomes close to the non-connection state, the intermediate rotator 72 is rotated to the non-connection state by the elastic force of the elastic member 75.

As shown in FIG. 11, when the displacement portion 741 is present at the locking position when the intermediate rotator 72 enters the non-connection state, the displacement portion 741 is hooked on an engaged portion 7212 of the intermediate rotator 72. With this configuration, the displacement portion 741, resisting against the elastic force of the elastic member 75A, stops the intermediate rotator 72 from rotating in the second rotation direction R2. This allows the intermediate rotator 72 to be kept in the non-connection state.

In addition, as shown in FIG. 12, when the displacement portion 741 is displaced from the engaging position to the retracting position when the intermediate rotator 72 is in the non-connection state, the displacement portion 741 is separated from the engaged portion 7212 of the intermediate rotator 72. This allows the displacement portion 741 to be released from being hooked on the engaged portion 7212 of the intermediate rotator 72. As a result, by the elastic force of the elastic member 75A, the intermediate rotator 72 is rotated in the second rotation direction R2.

The intermediate rotator 72 that has been rotated to the connection state by the elastic force of the elastic member 75A is further rotated in the second rotation direction R2 by the rotational force received from the input-side idle gear 711 of the input-side rotator 71.

In the following description, a mechanism that causes the intermediate rotator 72 in the non-connection state to rotate in the second rotation direction R2 by applying an elastic force thereto is referred to as an elastic rotation mechanism 750.

[Elastic Rotation Mechanism 750]

FIGS. 13-15 are front views of the elastic rotation mechanism 750 in the single-color developer supply portion driving mechanism 70. It is noted that the front direction of the elastic rotation mechanism 750 is the rear direction of the first intermittent transmission mechanism 79A shown in FIGS. 11 and 12.

FIG. 13 shows the elastic rotation mechanism 750 when the intermediate rotator 72 is in the non-connection state. In addition, FIGS. 14 and 15 show the elastic rotation mechanism 750 when the intermediate rotator 72 is in the connection state. It is noted that the circumferential portion of the intermediate output teeth missing gear 722 and the output-side rotator 73 are omitted in FIGS. 13-15 for the sake of convenience.

The elastic member 75A of the present embodiment is a coil spring. The elastic rotation mechanism 750 includes the elastic member 75A, a fixing supporting portion 751, and an eccentric portion 724 that forms a part of the intermediate rotator 72. The end portions of the elastic member 75A are respectively connected to the fixing supporting portion 751 and the eccentric portion 724.

The fixing supporting portion 751 supports one end portion of the elastic member 75A at a constant position. The fixing supporting portion 751 is, for example, a part of the housing 100. The eccentric portion 724 is a portion formed at a position in the intermediate rotator 72 biased to the outer circumference side from the rotation center of the intermediate rotator 72. In the present embodiment, the eccentric portion 724 is a part of the intermediate output teeth missing gear 722.

As shown in FIG. 13, when the intermediate rotator 72 is kept to be in the non-connection state by the actuator 74, an elastic force is acted by the elastic member 75A to the eccentric portion 724 in such a way as to cause the intermediate rotator 72 to rotate in the second rotation direction R2. This allows the actuator 74 to switch from the locking state to the retracting state, thereby the intermediate rotator 72 is rotated in the second rotation direction R2 by the elastic force of the elastic member 75A. This allows, as shown in FIG. 14, the first teeth 7111 of the input-side rotator 71 to mesh with the second teeth 7211 of the intermediate rotator, and the intermediate rotator 72 enters the connection state.

The intermediate rotator 72 is then rotated in the second rotation direction R2 by the rotational force received from the input-side rotator 71 when the intermediate rotator 72 is in the connection state, and the eccentric portion 724 is rotationally moved around the intermediate rotation shaft portion 72*s*.

As shown in FIG. 15, when the intermediate rotator 72 is in the halfway to the non-connection state, the eccentric portion 724 of the intermediate rotator 72 temporarily receives a force in the opposite direction to the second rotation direction R2 from the elastic member 75A. However, the intermediate rotator 72 is rotated in the second rotation direction R2 by the rotational force received from the input-side rotator 71 until immediately before the intermediate rotator 72 enters the non-connection state.

When the intermediate rotator 72 is in the state immediately before it enters the non-connection state, an elastic force that biases the intermediate rotator 72 to rotate in the second rotation direction R2 is acted from the elastic member 75A to the eccentric portion 724. As a result, while the actuator 74 is in the retracting state, the intermediate rotator 72 continues to rotate in the second rotation direction R2.

In addition, when the displacement portion 741 of the actuator 74 is displaced to the locking position before the intermediate rotator 72 enters the non-connection state, the actuator 74 enters the locking state. This allows the intermediate rotator 72 to be in the non-connection state while receiving the elastic force in the second rotation direction R2.

When the displacement portion 741 of the actuator 74 is displaced to the retracting position from the locking position, the intermediate rotator 72 is returned to the connection state by the elastic force of the elastic member 75A.

In the first intermittent transmission mechanism 79A, as in the first intermittent transmission mechanism 79, the intermediate rotator 72 makes at least one rotation each time the actuator 74 makes one operation. It is noted that it is possible to cause the intermediate rotator 72 to make as many rotations as an integer multiple of one each time the actuator 74 makes one operation, by adjusting the time period during which the actuator 74 is kept to be in the retracting state.

The first intermittent transmission mechanism 79A is a mechanism that can be realized in a simple configuration at a low cost by a simple actuator that allows a teeth missing gear and a displacement portion of a simple configuration to be displaced reciprocally.

Third Embodiment

Figure 16:
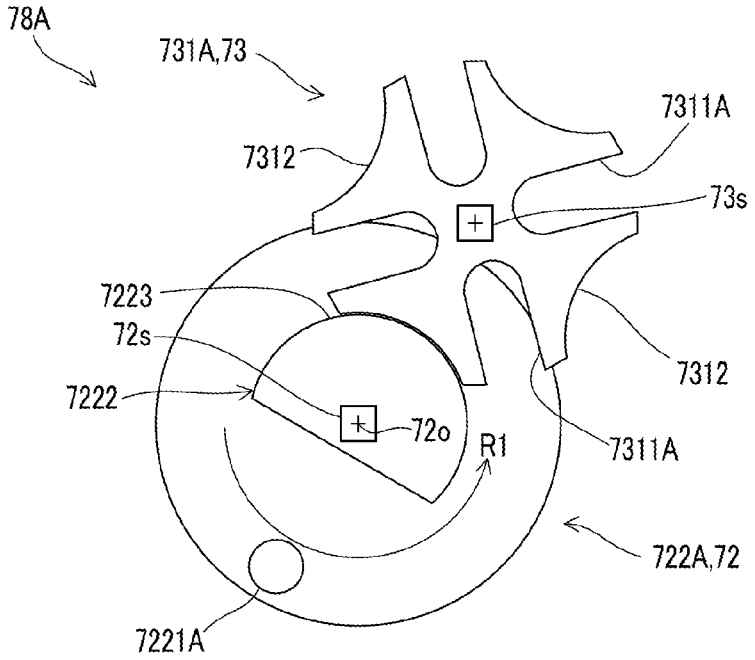
FIG. 16 is a first front view of a second intermittent transmission mechanism in an image forming apparatus according to the third embodiment of the present disclosure.
Figure 17:
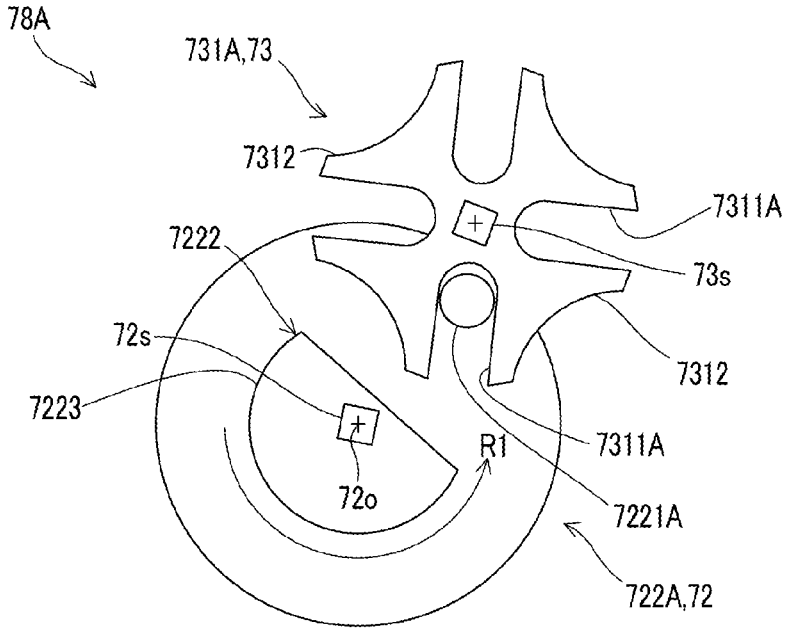
FIG. 17 is a second front view of the second intermittent transmission mechanism in the image forming apparatus according to the third embodiment of the present disclosure.

Next, a description is given of an image forming apparatus according to the third embodiment of the present disclosure with reference to FIGS. 16 and 17. The image forming apparatus of the third embodiment has a configuration where the second intermittent transmission mechanism 78 of the image forming apparatus 10 has been replaced with a second intermittent transmission mechanism 78A.

FIGS. 16 and 17 are front views of the second intermittent transmission mechanism 78A. It is noted that in FIGS. 16 and 17, the same components as those shown in FIGS. 1-14 are assigned the same reference signs.

In the image forming apparatus of the third embodiment, each single-color developer supply portion driving mechanism 70 includes the second intermittent transmission mechanism 78A instead of the second intermittent transmission mechanism 78. The second intermittent transmission mechanism 78A is a well-known Geneva drive.

The second intermittent transmission mechanism 78A includes a driving wheel 722A and a driven wheel 731A, wherein the driving wheel 722A is a part of the intermediate rotator 72, and the driven wheel 731A is a part of the output-side rotator 73.

The driving wheel 722A of the intermediate rotator 72 includes an engaging portion 7221A and a restricting portion 7222. Similar to the teeth 7221 of the intermediate output teeth missing gear 722, the engaging portion 7221A is formed on an area of the circumference of the intermediate rotator 72. The engaging portion 7221A is a projection portion formed to project along the direction of the rotation center line 72*o* of the intermediate rotator 72.

The driven wheel 731A of the output-side rotator 73 includes a plurality of engaged portions 7311A and a plurality of restricted portions 7312. The engaged portions 7311A are respectively provided on a plurality of areas of the circumference of the output-side rotator 73, and receive a rotational force from the engaging portion 7221A. The engaged portions 7311A are formed by cutting the driven wheel 731A of the output-side rotator 73 inside from a plurality of positions on the outer rim.

The second intermittent transmission mechanism 78A enters the second connection state each time the engaging portion 7221A is engaged with any of the engaged portions 7311A while the intermediate rotator 72 is rotating. Furthermore, the second intermittent transmission mechanism 78A enters the second non-connection state each time the outer circumferential surface 7223 of the restricting portion 7222 fits in any recess of the restricted portions 7312.

In the case where the second intermittent transmission mechanism 78A is adopted instead of the second intermittent transmission mechanism 78, the same effect is obtained as in the case where the second intermittent transmission mechanism 78 is adopted.

Fourth Embodiment

Figure 18:
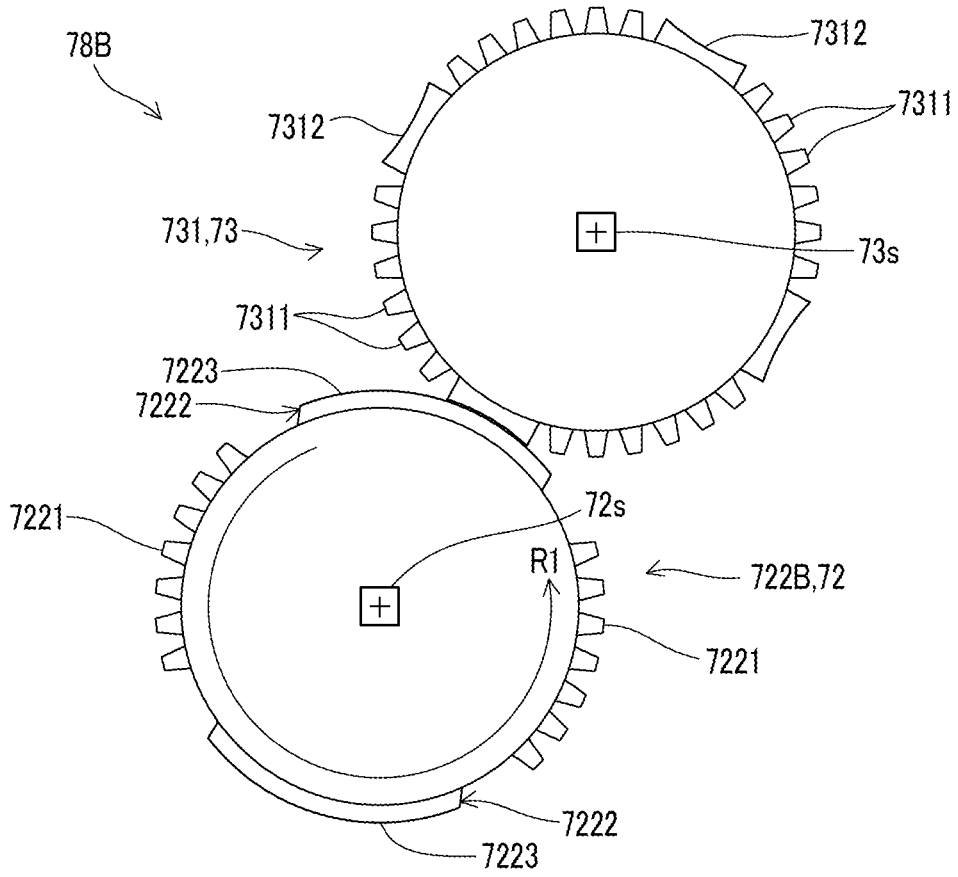
FIG. 18 is a front view of a second intermittent transmission mechanism in an image forming apparatus according to the fourth embodiment of the present disclosure.

Next, a description is given of an image forming apparatus according to the fourth embodiment of the present disclosure with reference to FIG. 18. The image forming apparatus of the fourth embodiment has a configuration where the second intermittent transmission mechanism 78 of the image forming apparatus 10 has been replaced with a second intermittent transmission mechanism 78B.

FIG. 18 is a front view of the second intermittent transmission mechanism 78B. It is noted that in FIG. 18, the same components as those shown in FIGS. 1-14 are assigned the same reference signs.

As shown in FIG. 18, the second intermittent transmission mechanism 78B includes a plurality of teeth 7221 and a plurality of restricting portions 7222 that are formed on the intermediate output teeth missing gear 722 of the intermediate rotator 72. Furthermore, similar to the second intermittent transmission mechanism 78, the second intermittent transmission mechanism 78B includes a plurality of teeth 7311 and a plurality of restricted portions 7312 that are provided on the output teeth missing gear 731 of the output-side rotator 73.

In the second intermittent transmission mechanism 78B, the plurality of teeth 7221 are formed on a plurality of areas of the circumference of the intermediate rotator 72. In addition, the plurality of restricting portions 7222 are formed respectively on the remaining areas of the circumference of the intermediate rotator 72. It is noted that the teeth 7221 are an example of the engaging portion.

It is noted, however, that on the circumference of the output-side rotator 73, the plurality of teeth 7311 and the plurality of restricted portions 7312 are formed on more areas in number than the areas on the intermediate output teeth missing gear 722 on which the teeth 7221 and the restricting portions 7222 are formed.

In the example shown in FIG. 18, in the second intermittent transmission mechanism 78B, the teeth 7221 are respectively formed on two areas of the circumference of the intermediate rotator 72. In addition, two restricting portions 7222 are respectively formed on the remaining two areas of the circumference of the intermediate rotator 72.

On the other hand, on the circumference of the output-side rotator 73, the plurality of teeth 7311 and the plurality of restricted portions 7312 are respectively formed on four areas.

With the adoption of the second intermittent transmission mechanism 78B, each time the intermediate rotator 72 makes one rotation, the output-side rotator 73 makes a plurality of rotations intermittently. The second intermittent transmission mechanism 78B as such may be adopted in the single-color developer supply portion driving mechanisms 70.

Application Examples

In the image forming apparatus 10, a driving source for the sheet conveying portion 3 and a driving source for the developing portion 43 may be provided individually. In that case, the input-side rotator 71 may be rotated by the rotational force received from the driving source for the developing portion 43.

In addition, a mechanism similar to the developer supply portion driving mechanism 7 may be applied to, for example, a driving mechanism for driving developer conveying portions such as an intermediate hopper portion that conveys developer between the developer supply portion 40 and the developing portion 43.

It is noted that the image forming apparatus of the present disclosure may be configured by, within the scope of claims, freely combining the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an input-side rotator configured to be rotated continuously by a rotational force transmitted from a driving source;

an intermediate rotator configured to be rotated by a rotational force transmitted from the input-side rotator:

an output-side rotator configured to be rotated by a rotational force transmitted from the intermediate rotator;

a developer conveying portion configured to be rotated by a rotational force transmitted from the output-side rotator and convey developer by being rotated;

a first intermittent transmission mechanism including an actuator and a switch transmission mechanism that is selectively switched between a first connection state and a first non-connection state;

a second intermittent transmission mechanism configured to be selectively switched between a second connection state and a second non-connection state while the intermediate rotator is rotating; and a control portion configured to output a control signal to the actuator, wherein the actuator operates based on the control signal input thereto, the first connection state is a state in which the rotational force of the input-side rotator is transmitted to the intermediate rotator based on an operation of the actuator, the first non-connection state is a state in which the rotational force of the input-side rotator is not transmitted to the intermediate rotator, the second connection state is a state in which the rotational force of the intermediate rotator is transmitted to the output-side rotator, the second non-connection state is a state in which the rotational force of the intermediate rotator is not transmitted to the output-side rotator, the second intermittent transmission mechanism includes:

an engaging portion provided on an area of circumference of the intermediate rotator;

a restricting portion provided on a remaining area of the circumference of the intermediate rotator and having an outer circumferential surface that extends along an arc whose center is a rotation center line of the intermediate rotator;

a plurality of engaged portions respectively provided on a plurality of areas of circumference of the output-side rotator and receiving a rotational force from the engaging portion; and a plurality of restricted portions provided respectively on a plurality of remaining areas of the circumference of the output-side rotator and each formed to have a recess indented in a shape of an arc so as to fit on the outer circumferential surface of the restricting portion, and the second intermittent transmission mechanism enters the second connection state each time the engaging portion is engaged with any of the engaged portions, and enters the second non-connection state each time the outer circumferential surface of the restricting portion fits in the recess of any restricted portion.

2. The image forming apparatus according to claim 1, wherein the second intermittent transmission mechanism further includes:

an intermediate output teeth missing gear including teeth and the restricting portion, the teeth constituting the engaging portion and formed on the area of the circumference of the intermediate rotator, the restricting portion being formed on the remaining area of the circumference of the intermediate rotator; and an output teeth missing gear including teeth and the restricted portions, the teeth constituting the engaged portions, configured to mesh with the teeth of the intermediate output teeth missing gear, and formed on the area of the circumference of the output-side rotator, the restricted portions being formed on the remaining area of the circumference of the output-side rotator.

3. The image forming apparatus according to claim 1, wherein the second intermittent transmission mechanism is a Geneva mechanism including:

the engaging portion formed on the intermediate rotator to project along the direction of the rotation center line of the intermediate rotator; and the engaged portions are formed by cutting the output-side rotator inside from a plurality of positions on outer rim thereof.

4. The image forming apparatus according to claim 1, wherein the switch transmission mechanism of the first intermittent transmission mechanism includes:

an input-side idle gear formed on the input-side rotator and having teeth formed around an entire circumference thereof;

an intermediate input teeth missing gear formed on the intermediate rotator, wherein a first teeth missing portion having no teeth is formed on an area of the circumference thereof, and teeth are formed on a remaining area of the circumference so as to mesh with the teeth of the input-side idle gear; and an elastic member configured to cause the intermediate rotator to rotate from the first non-connection state to the first connection state by applying an elastic force to the intermediate rotator, wherein in the first non-connection state, the first teeth missing portion faces the input-side idle gear, and in the first connection state, the teeth of the intermediate input teeth missing gear mesh with the teeth of the input-side idle gear, the actuator is switched between a locking state and a retracting state based on the control signal input thereto, the locking state is a state where the actuator is engaged with the intermediate rotator and thereby the intermediate rotator is kept to be in the first non-connection state, and the retracting state is a state where rotation of the intermediate rotator is not restricted.

5. The image forming apparatus according to claim 1, wherein the second intermittent transmission mechanism further includes:

a plurality of engaging portions respectively provided on a plurality of areas on the circumference of the intermediate rotator, and a plurality of restricting portions respectively provided on a plurality of remaining areas on the circumference of the intermediate rotator; and a plurality of engaged portions and a plurality of restricted portions that are formed on more areas in number than the areas on the intermediate rotator on which the engaging portions and the restricting portions are provided.

6. The image forming apparatus according to claim 1, wherein the input-side rotator is rotated by a power received from a driving source for driving a sheet conveying portion that conveys a recording sheet on which images of developer are transferred.

7. The image forming apparatus according to claim 6 further comprising a plurality of image forming portions each of which includes the input-side rotator, the intermediate rotator, the output-side rotator, the developer conveying portion, the first intermittent transmission mechanism, and the second intermittent transmission mechanism, wherein the input-side rotator in each of the image forming portions is rotated by a power received from the driving source that is used in common for the sheet conveying portion and the input-side rotator.

8. The image forming apparatus according to claim 1, wherein the actuator is a solenoid actuator.

9. The image forming apparatus according to claim 1 further comprising:

a developer supply portion including a container and the developer conveying portion, the container storing developer, the developer conveying portion conveying the developer in the container;

a developing portion to which the developer is supplied from the developer supply portion by the developer conveying portion; and a developer amount sensor configured to detect an amount of developer in the developing portion, wherein when the developer amount sensor satisfies a predetermined supply condition while the driving source is operating, the control portion outputs the control signal so as to switch a state of the actuator.

* * * * *